US005963993A

United States Patent [19]

Dunn

[11] Patent Number: 5,963,993

[45] Date of Patent: Oct. 12, 1999

[54] BATH SPONGE SUPPORT FOR INFANTS

[76] Inventor: Steven B. Dunn, 2069 Coldwater Canyon, Beverly Hills, Calif. 90210

[21] Appl. No.: 09/046,173

[22] Filed: Mar. 23, 1998

[51] Int. Cl.[6] ..... A47K 3/024

[52] U.S. Cl. ..... 4/572.1; 4/586; 4/659

[58] Field of Search ..... 4/572.1, 573.1, 4/575.1, 581, 585, 586, 659; D23/278; 116/216; 374/141, 161, 162

[56] References Cited

U.S. PATENT DOCUMENTS

| | | | |
|---|---|---|---|
| D. 103,216 | 2/1937 | Cevasco . | |
| D. 202,691 | 11/1965 | Essman . | |
| D. 206,747 | 1/1967 | Essman . | |
| D. 237,118 | 10/1975 | Grelle . | |
| D. 251,303 | 3/1979 | Boissonneault . | |
| D. 259,274 | 5/1981 | Humes . | |
| D. 259,458 | 6/1981 | Fuller et al. . | |
| D. 260,281 | 8/1981 | Rist . | |
| D. 329,278 | 9/1992 | Gallup . | |
| 2,167,178 | 7/1939 | Kohlstadt . | |
| 2,358,003 | 9/1944 | Puy . | |
| 2,531,724 | 11/1950 | Cevasco . | |
| 3,341,866 | 9/1967 | Wright . | |
| 4,266,306 | 5/1981 | Lee . | |
| 4,512,044 | 4/1985 | Clark . | |
| 4,929,091 | 5/1990 | Kostic et al. | 374/162 |
| 4,969,226 | 11/1990 | Seville . | |
| 5,173,346 | 12/1992 | Middleton . | |
| 5,375,271 | 12/1994 | Frankel | 4/581 |
| 5,425,149 | 6/1995 | Crossley et al. | 4/575.1 X |
| 5,473,788 | 12/1995 | Aragona . | |
| 5,499,597 | 3/1996 | Kronberg | 116/216 |
| 5,720,555 | 2/1998 | Elele | 374/141 X |
| 5,786,578 | 7/1998 | Christy et al. | 116/216 X |

FOREIGN PATENT DOCUMENTS

| | | | |
|---|---|---|---|
| 0 432 514 A2 | 11/1990 | European Pat. Off. . | |
| 30 20 961 | 6/1980 | Germany . | |
| 2108838 | 5/1983 | United Kingdom | 4/581 |

*Primary Examiner*—David J. Walczak
*Assistant Examiner*—Kathleen J. Prunner
*Attorney, Agent, or Firm*—Knoble & Yoshida LLC

[57] ABSTRACT

An article for supporting an infant during bathing includes a body portion having a top surface that is constructed and shaped to support an infant, and a bottom surface. The body portion is made out of a material that is compressible and water-absorbent material, such as a sponge-like polymeric foam. A passage is defined in the body portion for permitting bath water to flow unimpeded through the body portion from beneath the bottom surface to above the top surface when the article is placed bottom surface down into bath water. As a result, bath water will be absorbed into the body portion, and particularly into the top surface, more quickly than was heretofore possible with conventional bath supports. A second aspect involves a torso-receiving portion of the body portion, which is made to be more compressible than other regions so as to ensure that an infant's torso is as immersed as possible during bathing. A third aspect involves the presence of a temperature warning device, which warns the caregiver when the bath water is above a predetermined temperature.

21 Claims, 5 Drawing Sheets

BATH SPONGE SUPPORT FOR INFANTS

BACKGROUND OF THE INVENTION

1. Field of the Invention

This invention relates to the field of infant care and safety and, more specifically, to an improved bath sponge support for an infant that is easier for a caregiver to use, safer and more comfortable for an infant than conventional bath sponge supports.

2. Description of the Related Technology

Bath sponge supports are commercially available in several shapes, sizes, and colors. These products are typically made of a compressible, water-absorbent sponge-like material such as polyurethane foam, and are contoured to fit a small infant. They are generally thicker towards the infant's head and thinner towards his or her leg area to allow water to drain away from the head toward a tub drain. Examples of such sponge supports can be found in U.S. Design Pat. Nos. 259,274 to Humes, 260,281 to Rist, 329,278 to Gallup, and 259,458 to Fuller et al.

Bath sponge supports are generally used inside a small baby bath tub or a sink. The sponge support is first placed inside a dry tub or sink. Warm bath water is added, then the caregiver presses down on the sponge support to draw water into the sponge-like material. This usually takes a few moments, during which time the caregiver may be preoccupied and not pay close attention to the infant. The caregiver next places the infant on the sponge support, and proceeds to give the infant a bath while the infant is partially immersed.

Infants have sensitive skin, and are particularly sensitive to temperature variations, such as hot water, or the chill that is associated with wet skin being exposed to air during bathing. It is therefore important to bathe an infant in a warm room, and as quickly as possible, and with as little of the infant as possible being exposed to the air while wet. Bath water cools quickly and the water on top of the sponge support that is in contact with the infant cools faster than the water that is beneath the sponge support. This effect is magnified because the sponge support itself blocks water circulation between the top and bottom of the sponge support.

Most caregivers know that it is essential to check the temperature of the water before bathing the infant too make certain that it is not too hot. Unfortunately, incidents still occur where an infant is exposed to bath water that is too hot. This can result in anything from mild discomfort for the infant to serious bums.

A need exists for an improved bath sponge support that is constructed to have water drawn therein as quickly as possible, so that a caregiver can prepare to bathe an infant as quickly as possible. In addition, a need exists for an improved bath sponge support that is constructed to promote water circulation within the baby bath tub or sink during bathing, so as to minimize differences in temperature and soap concentration within the bath water. Moreover, a need exists for an improved bath sponge support that is constructed to warn a caregiver when the bath water is above a predetermined safe temperature.

SUMMARY OF THE INVENTION

Accordingly, it is an object of the invention to provide an improved bath sponge support that is constructed to have water drawn therein as quickly as possible, so that a caregiver can prepare to bathe an infant as quickly as possible.

In it further an object of the invention to provide an improved bath sponge support that is constructed to promote water circulation within the baby bath tub or sink during bathing, so as to minimize differences in temperature and soap concentration within the bath water.

It is yet further an object of the invention to provide an improved bath sponge support that is constructed to warn a caregiver when the bath water is above a predetermined safe temperature.

In order to achieve the above and other objects of the invention, an article for supporting an infant during bathing includes, according to a first aspect of the invention, a body portion having a top surface that is constructed and shaped to support an infant, and a bottom surface, the body portion comprising a compressible, water-absorbent material; and passage structure defined in the compressible, water-absorbent material of the body portion for permitting bath water to flow unimpeded through the body portion from beneath the bottom surface to above the top surface when the article is placed bottom surface down into bath water, whereby water circulation will be enhanced during bathing, and bath water will be absorbed into the body portion, and particularly into the top surface, more quickly than was heretofore possible with conventional bath supports.

According to a second aspect of the invention, an article for supporting an infant during bathing includes a body portion including a compressible, water-absorbent material, the body portion having a top surface that is constructed and shaped to support an infant, and a bottom surface; and wherein the body portion includes a torso-receiving area for receiving an infant's torso during bathing, the torso receiving area being constructed and arranged so as to be more easily compressible than areas of the body portion that are not within the torso receiving area, whereby the article will permit an infant's torso to be more fully immersed in bath water during bathing than was possible with conventional infant bath supports.

According to a third aspect of the invention, an article for supporting an infant during bathing includes a body portion comprising a compressible, water-absorbent material, the body portion having a top surface that is constructed and shaped to support an infant, and a bottom surface; and temperature safety structure for warning when the article is placed in bath water that is above a predetermined temperature.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
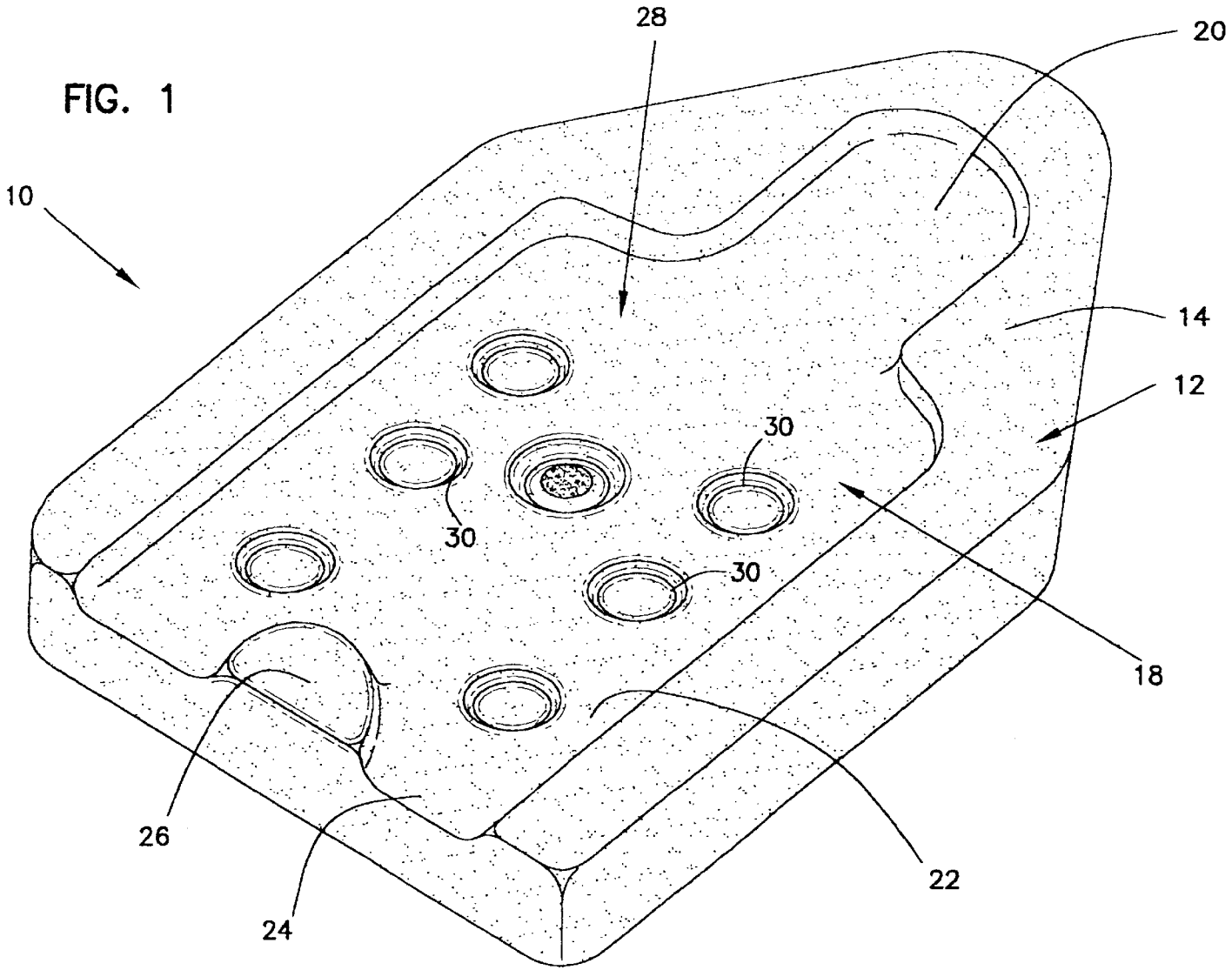
FIG. 1 is a perspective view of a bath sponge support that is constructed according to a first preferred embodiment of the invention.

Referring now to the drawings, wherein like reference numerals designate corresponding structure throughout the views, and referring in particular to FIG. 1, an article 10 for supporting an infant during bathing includes a body portion 12 having a top surface 14 that is constructed and shaped to support an infant, and a bottom surface 16, best shown in FIG. 4, that is preferably flat, but could alternatively be constructed as defined below with reference to FIG. 5. As may be seen in FIGS. 1 and 2, body portion 12 is fabricated from a compressible, water absorbent material, such as a foamed polymer. Most preferably, body portion 12 is fabricated from foamed polyurethane. As maybe seen in FIG. 1, body portion 12 has a recess 18 defined therein and a top surface 14 that is in general conformance with the body of an infant. Recess 18 includes a portion 20 that is recessed to receive the head of an infant, a portion 22 that is shaped to receive the torso of an infant, and a pair of recesses 24 that are shaped to receive the upper legs of an infant. For purposes of this document, a torso is defined so as to include the buttocks area. As may be seen in FIG. 1, a bolster 26 is provided for conforming to the upper thighs and buttocks of the infant.

Figure 2:
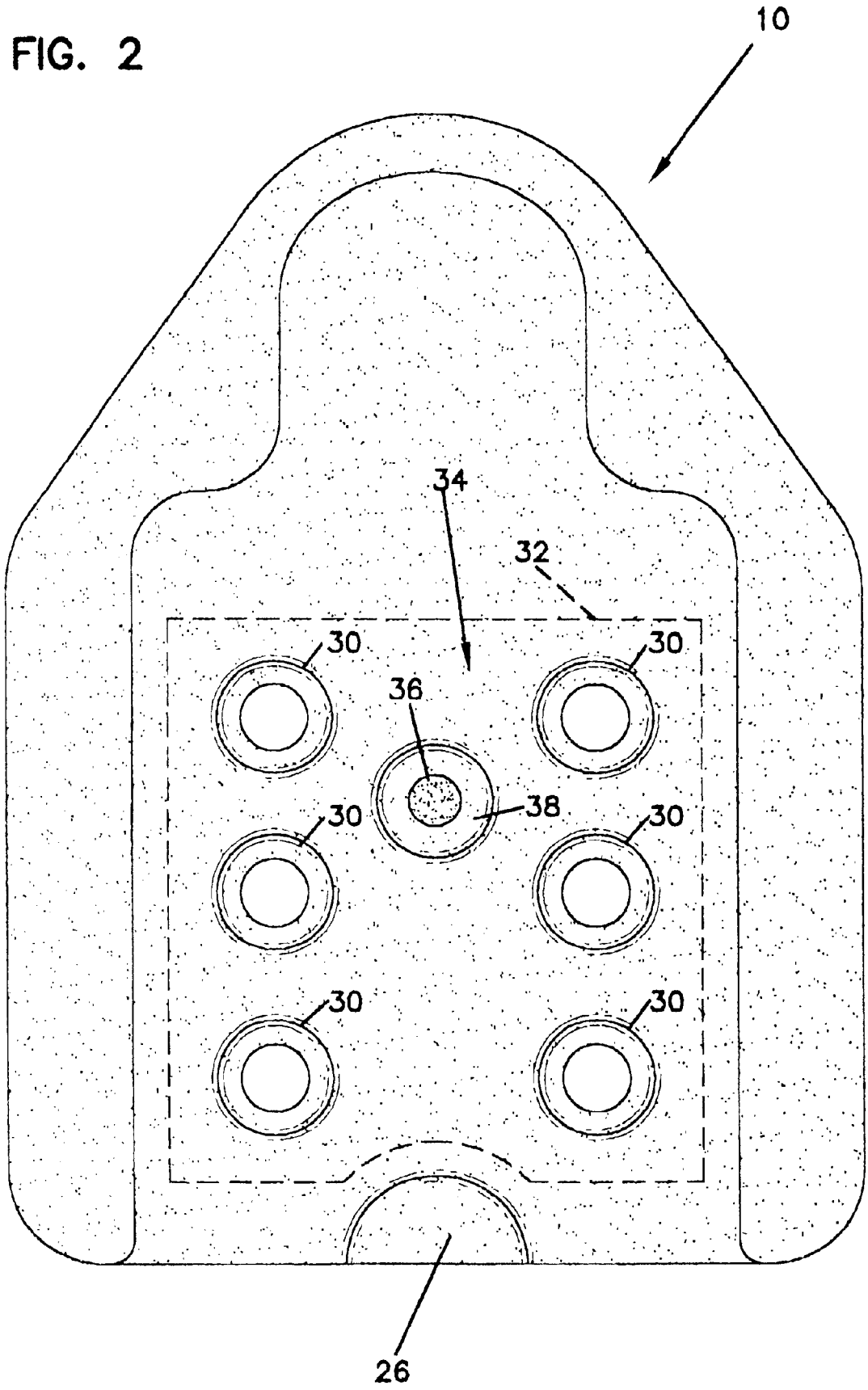
FIG. 2 is a top plan view of the bath sponge support that is depicted in FIG. 1.
Figure 3:
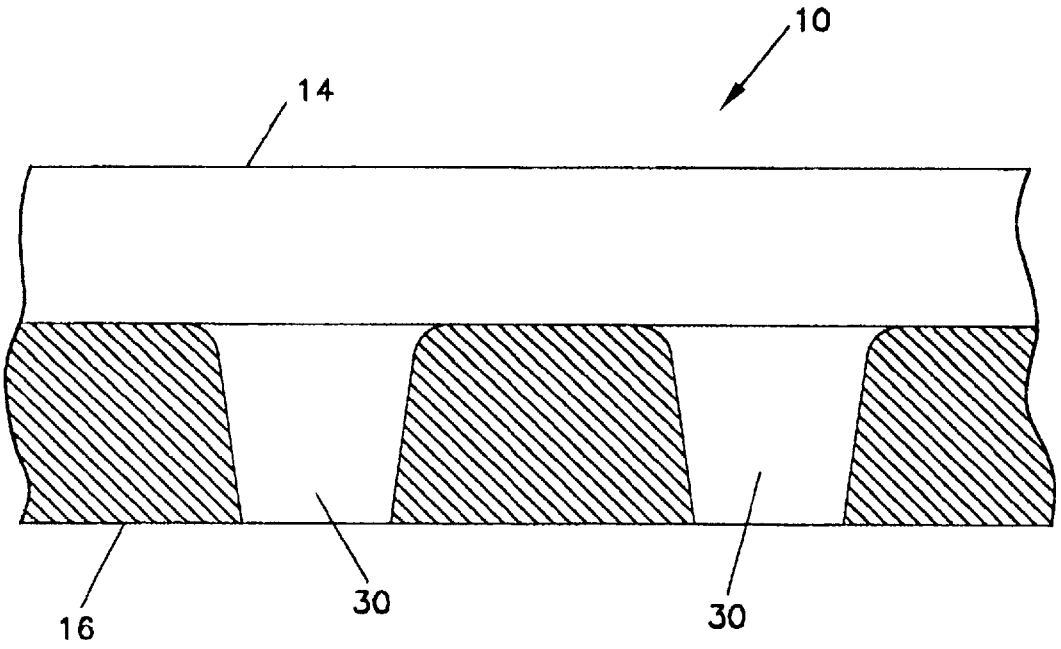
FIG. 3 is a fragmentary cross-sectional view taken through a portion of the sponge support that is illustrated in FIGS. 1 and 2.

As may be seen in FIGS. 1–3, passage structure 28 is defined in the compressible, water absorbent material of body portion 12 for permitting bath water to flow unimpeded through the body portion 12 from beneath the bottom surface 16 to above the top surface 14 when the article is placed, bottom surface down, into bath water, so that water circulation will be enhanced during bathing. This acts to reduce temperature and soap concentration gradients within the bath water during bathing. In addition, the presence of passage structure 28 ensures that bath water will be absorbed into the body portion 12, and particularly into the top surface 14, more quickly than was heretofore possible with conventional bath supports. In addition, the presence of the passage structure 28 aids the rinsing action as the caregiver typically pours clean water on the infant to wash off soap. The soap is removed from the infant more quickly, and fresh water can be used to fill the sink or baby bath tub faster than would otherwise be possible. In the preferred embodiment, passage structure 28 is embodied as a plurality of holes 30 that extend through the entire thickness of the body portion 12. In the illustrated embodiment, there are six such holes 30.

As is best shown in FIG. 2, a number of the holes 30 are positioned within an area 32 on body portion 12 where the infant's torso is intended to be positioned. As a result of the presence of the holes 30, the compressible, water absorbent material is made more compressible on average within this area 32, which has the effect of causing the infant to sink down into the body portion 12 and be as fully immersed as possible in the bath water as possible while being bathed. This also has the effect of helping to keep the infant centered with respect to the article 10 during bathing.

According to another important aspect of the invention, article 10 further includes a temperature safety system 34 for providing a warning to the caregiver when article 10 is placed in bath water that is above a predetermined temperature. In the illustrated embodiment, temperature safety system 34 includes a thermochromic material 36 that is secured to the compressible, absorbent material of body portion 12. In addition, thermochromic material 36 is positioned in a recess 38 that is defined in the top surface 14 of body portion 12. This has two advantages. First, placing the thermochromic material 36 within the recess makes it more difficult for a infant or other child to pull the thermochromic material 36 out of the recess 38. In addition, by placing the thermochromic material 36 within the recess 38, the thermochromic material 36 is placed further down within the sink or baby bath tub, so that it can be a more effective indicator of the temperature of the bath water. It is also to be noted that the temperature safety system 34 is positioned so that it is visible when viewing the top surface of the body portion 12 of the article 10, so that it can be easily noticed by a caregiver.

Figure 4:
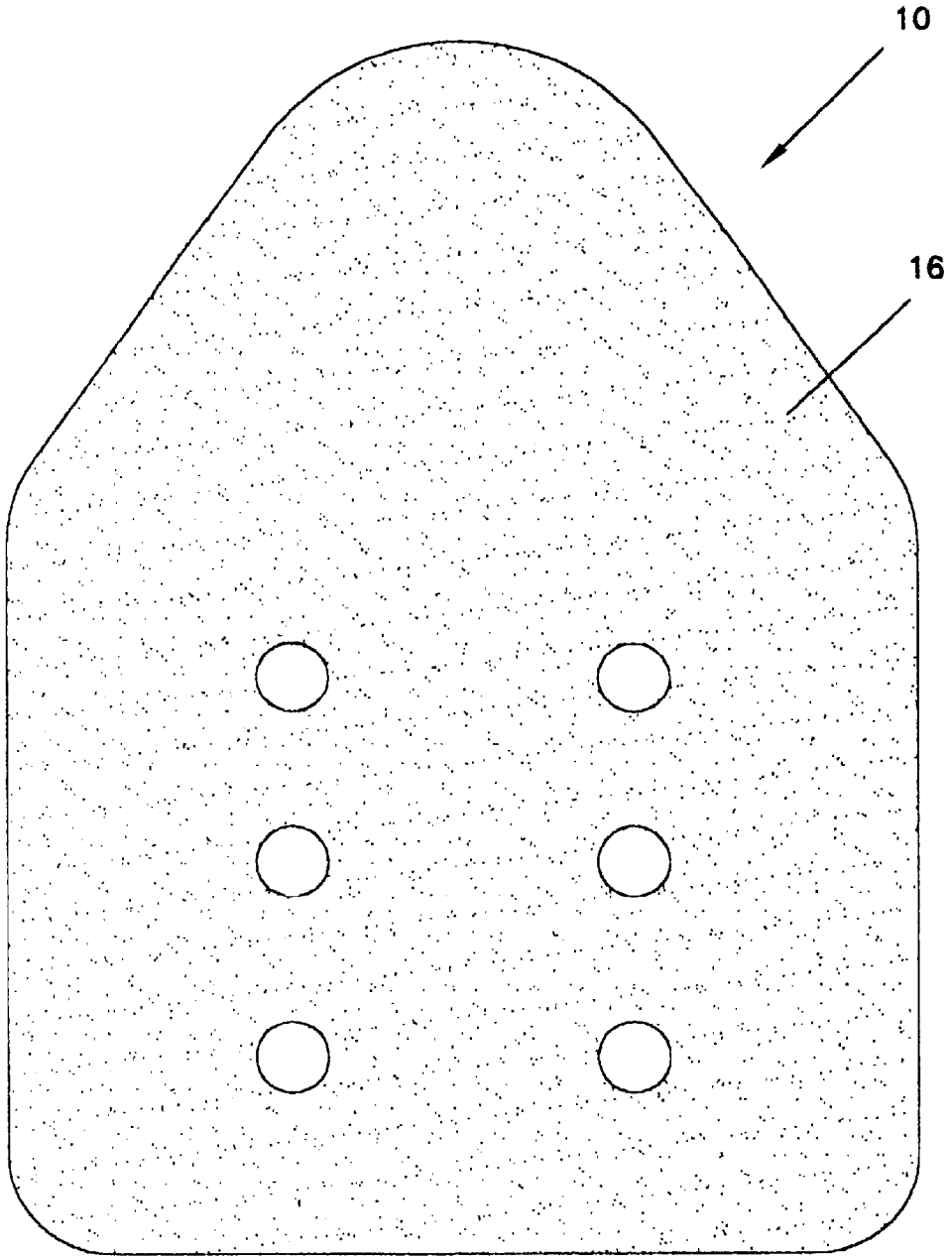
FIG. 4 is a bottom plan view of the sponge support shown in FIGS. 1–4.
Figure 5:
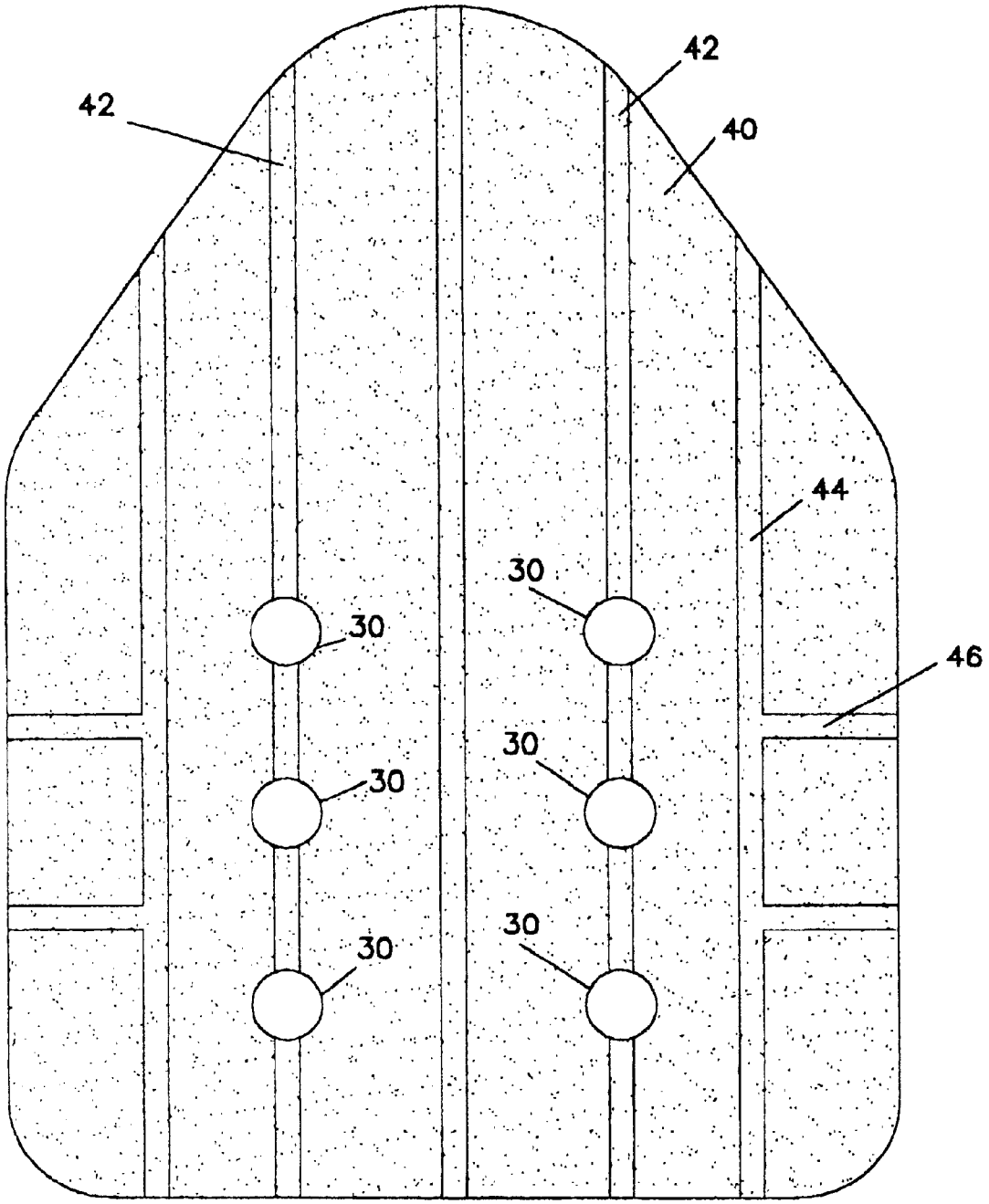
FIG. 5 is a bottom plan view of a sponge support that is constructed according to a second, alternative embodiment of the invention.

Referring now to FIG. 4, the bottom surface 16 of the article 10 is preferably relatively flat. In another embodiment of the invention, however, which is depicted in FIG. 5, a bottom surface 40 is characterized by the presence of a number of longitudinal channels 42 that are positioned to drain bath water from the body portion 12. These slots or channels 42 are preferably in communication with one or more of the holes 30, so that water can quickly drain off of the top surface 14 of the article 10 by flowing through the hole 30, and then through the longitudinal channel 42. As is also shown in FIG. 5, an additional one or more channels 44 may be defined in bottom surface 40 that are not in communication with holes 30. Also, one or more transverse channels 46 may be provided to enhance drainage from the longitudinal channels 44.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An article for supporting an infant during bathing, comprising:

a body portion having a top surface that is constructed and shaped to support an infant, and a bottom surface, said body portion comprising a compressible, water-absorbent material; and passage means defined in said compressible, water-absorbent material of said body portion for permitting bath water to flow unimpeded through said body portion from beneath said bottom surface to above said top surface when the article is placed bottom surface down into bath water, whereby water circulation will be enhanced during bathing, and bath water will be absorbed into said body portion, and particularly into said top surface, more quickly than was heretofore possible with conventional bath supports.

2. An article according to claim 1, wherein said top surface has a recess defined therein that is in general conformance with the body of an infant.

3. An article according to claim 1, wherein said passage means comprises at least one hole that extends through an entire thickness of said body portion.

4. An article according to claim 3, wherein said passage means comprises a plurality of said holes.

5. An article according to claim 4, wherein a number of said holes are positioned about an area where an infants torso will be positioned, whereby said compressible, water-absorbent material is made more compressible in the area where the infant's weight will be applied, so as to cause the infant to sink down into the body portion to become more fully immersed in the bath water during bathing.

6. An article according to claim 1, further comprising temperature safety means for warning when said article is placed in bath water that is above a predetermined temperature.

7. An article according to claim 6, wherein said temperature safety means comprises a thermochromic material.

8. An article according to claim 6, wherein said temperature safety means is mounted to said compressible, water-absorbent material, whereby the temperature of the bath water can be sensed through the compressible, water-absorbent material.

9. An article according to claim 6, wherein said temperature safety means is mounted on a portion of said body portion that is constructed and shaped to receive an infant's torso.

10. An article according to claim 6, wherein said temperature safety means is located so as to be visible when viewing said top surface of said body portion.

11. An article according to claim 6, wherein said temperature safety means is slightly recessed from said top surface so as to be in better, more continuous contact with bath water.

12. An article according to claim 1, further comprising drainage means defined in said bottom surface for facilitating water drainage from said body portion.

13. An article according to claim 12, wherein said drainage means comprises at least one slot defined in said bottom surface, and wherein said slot is in communication with said passage means, whereby water can quickly drain off of the top surface of said article by flowing through said passage means, and then through said drainage means.

14. An article for supporting an infant during bathing, comprising:

a body portion comprising a compressible, water-absorbent material, said body portion having a top surface that is constructed and shaped to support an infant, and a bottom surface; and wherein said body portion includes a torso-receiving area for receiving an infant's torso during bathing, said torso receiving area being constructed and arranged so as to be more easily compressible than areas of said body portion that are not within said torso receiving area, whereby the article will permit an infant's torso to be more fully immersed in bath water during bathing than was possible with conventional infant bath supports.

15. An article according to claim 14, wherein said torso receiving area is made more compressible as a result of a plurality of holes that are defined in said compressible, water-absorbent material of said body portion, said holes being arranged to permit bath water to flow unimpeded through said body portion from beneath said bottom surface to above said top surface when the article is placed bottom surface down into bath water, whereby bath water will be absorbed into said body portion, and particularly into said top surface, more quickly than was heretofore possible with conventional bath supports.

16. An article for supporting an infant during bathing, comprising:

a body portion comprising a compressible, water-absorbent material, said body portion having a top surface that is constructed and shaped to support an infant, and a bottom surface; and temperature safety means for warning when said article is placed in bath water that is above a predetermined temperature.

17. An article according to claim 16, wherein said temperature safety means comprises a thermochromic material.

18. An article according to claim 16, wherein said temperature safety means is mounted to said compressible, water-absorbent material, whereby the temperature of the bath water can be sensed through the compressible, water-absorbent material.

19. An article according to claim 16, wherein said temperature safety means is mounted on a portion of said body portion that is constructed and shaped to receive an infant's torso.

20. An article according to claim 16, wherein said temperature safety means is located so as to be visible when viewing said top surface of said body portion.

21. An article according to claim 16, wherein said temperature safety means is slightly recessed from said top surface so as to be in better, more continuous contact with bath water.

* * * * *